US008088208B2

(12) United States Patent
Stötzel et al.

(10) Patent No.: US 8,088,208 B2
(45) Date of Patent: Jan. 3, 2012

(54) HIGHLY INSULATING AND FIREPROOF COATING MATERIALS FOR CASTING MOULDS

(75) Inventors: Reinhard Stötzel, Borken (DE); Herbert Pitamitz, Wuppertal (DE); Gernot Lederer, Ettlingen (DE)

(73) Assignee: Ashland-Sudchemie-Kernfest GmbH, Wulfrath (DE)

( * ) Notice: Subject to any disclaimer, the term of this patent is extended or adjusted under 35 U.S.C. 154(b) by 825 days.

(21) Appl. No.: 11/792,936

(22) PCT Filed: Dec. 2, 2005

(86) PCT No.: PCT/EP2005/012917

§ 371 (c)(1),
(2), (4) Date: Jun. 30, 2008

(87) PCT Pub. No.: WO2006/063696

PCT Pub. Date: Jun. 22, 2006

(65) Prior Publication Data

US 2009/0014145 A1 Jan. 15, 2009

(30) Foreign Application Priority Data

Dec. 16, 2004 (DE) ..... 10 2004 060 649

(51) Int. Cl.

| | |
|---|---|
| ***C09D 1/00*** | (2006.01) |
| ***C09D 5/00*** | (2006.01) |
| ***B28B 7/36*** | (2006.01) |
| ***B28B 7/38*** | (2006.01) |

(52) U.S. Cl. ..... 106/38.22; 106/38.25; 106/38.27

(58) Field of Classification Search ..... 106/38.22, 106/38.25, 38.27

See application file for complete search history.

(56) References Cited

U.S. PATENT DOCUMENTS

| | | | | |
|---|---|---|---|---|
| 2007/0034115 | A1 | 2/2007 | Stotzel et al. | |
| 2010/0224755 | A1 * | 9/2010 | Stotzel et al. | 249/114.1 |

FOREIGN PATENT DOCUMENTS

| | | |
|---|---|---|
| DE | 4014322 | 11/1991 |
| DE | 69719845 | 11/2003 |
| EP | 0 589 051 | 3/1994 |
| EP | 0 806 258 | 11/1997 |
| EP | 0806258 | 11/1997 |
| FR | 2829048 | 3/2003 |

OTHER PUBLICATIONS

International Search Report, Mar. 21, 2006 (3 pgs).
Translation of "Substantiation of Opposition, Presentation of Facts, Explanation of Evidence" from Opposition of EP 1841556, (Dec. 2009).
Translation of Solemn Declaration of Dr. Klaus Seeger with appendices from EP 1841556 Opposition, (Apr. 2009).
Vanderbilt Technical Data, "PYRAX® RG.", (Dec. 2009).
DIN 51720, "Testing of solid fuels—determination of volatile matter content." (Mar. 2001).
DIN 53194, "Testing of pigments and other powdered or granulated materials; determination of tamped volume and tamped apparent density." (Apr. 1975).
Detail display of DIN EN ISO 60:200-01, "Plastics—Determination of apparent density of material that can be poured from a specified funnel," www.beuth.de., (Jan. 2000).
Detail display of DIN 53109:2008-05, "Testing of paper and board—Determination of abrasion by the abrasion wheel method," www.beuth.de., (May 2008).
Inspection instruction, Rohstoffspezifikation PYRAX RG 140, (Dec. 2009).
C. H. Erbslöh, Produktspezifikation PYRAX RG 140/h Euroquality, (Dec. 2009).
Internet Printout, Surfynol®, Dynol™ and EnviroGem®, www.airproducts.de, (Dec. 2009).
Leaflet, Schüler & Mayr, Parmetol®, (Dec. 2009).
Internet Printout, Proxel™, www.archchemicals.com, (Dec. 2009).
Translation of Solemn Declaration of Thomas Linke from EP 1841556 Opposition, (Oct. 2009).
S. Rudolph, "Elektronenmikroskopische Untersuchungen zur Wirkungsweise von Form- und kernschlichten," Gieβerei-Praxis No. 6. (1993).
DIN-TERM Beschichtungsstoffe, Zugangsnummer: E02B822, pp. 38-39, (2001).
S. Rudolph: "Betrachtungen zum Aufbau von Form- und Kernschlichten unter besonderer Berücksichtigung ihrer feuerfesten Bestandteile," Gieβerei-Praxis No. 8, pp. 165-178. (1994).
H. Gerald Levelink/F.P. Julien, Apeldoorn (Netherlands); "Better mould and core coatings for decreasing cleaning efforts," Gieβerei 66, No. 12, pp. 456-459 (1979).

* cited by examiner

*Primary Examiner* — David M Brunsman
(74) *Attorney, Agent, or Firm* — Kagan Binder, PLLC

(57) ABSTRACT

The present invention relates to wash compositions which comprise a solvent component and a solids component wherein the solvent component comprises as main component water or one or more alcohols, and the solids component comprises as main component a mixture of metakaolinite and pyrophyllite, which can be applied onto casting molds, casting molds comprising these wash compositions and the use thereof, in particular in centrifugal casting processes and large-scale casting processes.

45 Claims, No Drawings

HIGHLY INSULATING AND FIREPROOF COATING MATERIALS FOR CASTING MOULDS

The present invention relates to coating materials or wash compositions comprising a solvent component and a solids component, wherein the solids component comprises metakaolinite and pyrophyllite, which can be applied to casting moulds, casting moulds comprising the wash compositions, and the use thereof, in particular in centrifugal casting processes, and large-scale casting processes.

Liquid molten materials are transferred by casting into geometrically defined articles having certain workpiece properties. Most of the products of the iron and steel industry as well as the workpieces of the nonferrous-metal industry pass through casting processes for a first shaping. A prerequisite for the production of mould castings is inter alia the manufacture of casting moulds for the uptake of the molten mass, the casting moulds being very complicated to some extent. The casting moulds are subdivided into broken moulds which mostly consist of a mineral fireproof granular base material having a binder and often also various further additives, e.g. for achieving good casting surfaces, the broken moulds being destroyed after every casting, and permanent moulds with which a large number of mould castings can be produced in each case. Washed classified quartz sand and in certain cases also chromite, zirconite and olivine sand is used as fireproof granular base material for broken moulds. Apart from that also moulding materials on the basis of chamotte as well as magnesite, sillimanite, corundum and the like are used. The binder for the moulding sands may be inorganic or organic. Broken moulds are mainly produced from bentonite-bonded moulding materials for smaller moulds or synthetic resin-bonded moulding materials for larger moulds, which have to be mechanically compressed for achieving sufficient stability. Especially cast iron as well as unalloyed and alloyed steels but also copper, aluminium, graphite, sintered metals and ceramic materials have proven of value as moulding material for permanent moulds, depending on the field of application. Ingot mould casting, pressure die casting, centrifugal casting and continuous casting processes are among the permanent moulding processes.

A process for the production of casting moulds and cores made of synthetic resin-bonded moulding sand comprises for example the production of a basic mould or a basic core from the moulding sand and the application of a fireproof mould coating containing fireproof inorganic components, which is also called wash, at least onto the surfaces of the basic mould/basic core which are contacted with the casted metal. On the one hand, the mould coatings serve for influencing the surface of the mould, improving the appearance of the mould casting, metallurgically influencing the mould casting and/or avoiding defects in casting. Furthermore, these coatings or washes have the function to chemically isolate the mould from the liquid metal during casting, whereby any adhesion is prevented and the subsequent separation of the mould and the casting is enabled. Moreover, the wash guarantees a thermal separation of the mould and the casting. If this function is not fulfilled, a metal mould is, e.g., subjected to such thermal load during the consecutive casting processes that it is destroyed ahead of time. The heat transfer can be specifically used to influence the cooling of the casting. For the production of metal parts, for example made of cast iron, inter alia the large-scale casting process and the centrifugal casting process are used. During the large-scale casting process enormous metallostatic pressures act on the mould and the core which are also subjected to temperature load for a very long time. Therefore, especially in this process, the wash has a very exposed protection function in order to prevent the infiltration of the metal into the moulding sand (penetration), breaking of the cores (leaf ribs) or a reaction with the moulding sand (burning-in). In the centrifugal casting process the casting metal is filled into a tubular or annular ingot mould rotating on its axis, wherein it is formed to, e.g., cans, rings and tubes by the exposure to centrifugal force. It is absolutely necessary that the casting completely solidifies before it is removed from the mould so that a rather long contact time between mould and casting is required. In this case the mould is coated with an insulating wash in the form of a single-layered or multi-layered coating.

The commonly used washes contain for example clays, quartz, diatomite, cristobalite, tridymite, aluminium silicate, zirconium silicate, mica, chamotte and also coke and graphite as base materials. These base materials constitute the functional portion of the washes, which cover the surface of the mould and close the pores so that the casting metal cannot penetrate.

Due to its high insulating capacity products made of silica and diatomite are often preferred, since their production costs are low and their availability is good.

Presently, there are three processes for producing centrifugally cast pipes:

One process uses a powder wash based on inoculant and graphite, sometimes with portions of aluminium. This wash is distributed by means of a sliced tube filled with the powder wash by spinning in the rotating ingot mould. A further process uses a finished wash based on water with the fireproof substances zirconium silicate, aluminium silicate and/or aluminum oxide. This wash is sprayed onto the hot rotating ingot mould in one or more operations from a pressure vessel via a splash lance having a spray or flood nozzle. A further process uses a prepared water wash of fillers consisting of calcined diatomite (such as for example the commercially available products Celite, Dicalite) with bentonite and water.

Centrifugal casting washes, which are essentially used today are based on diatomite. However, the rotation of the mould during the centrifugal casting process and the after-treatment of the casting often effect that a part of the wash reaches the environment. Dust forms of diatomite, burnt diatomite and products which develop during the baking of diatomite, such as e.g., cristobalite-containing fine dust, are meanwhile classified as producing silicosis and also being carcinogenic. This is a high risk potential for the employees at work. Thus, there is a high need for another highly insulating and at the same time fireproof coating material for mould coatings.

EP-B-0 806 258 describes a process for producing an insulating coating for metal moulds for the casting of iron-containing metals, wherein at least one undercoating is applied onto the surface of the mould, and wherein a top coating is applied onto the undercoating, wherein the top coating contains metakaolin and is completely or partially rebuild during every casting operation. However, the pure use of metakaolin in the centrifugal casting process led to jamming of the tubes and the tubes could not be drawn sufficiently.

FR-A-2 829 048 describes a wash composition comprising water, metakaolin, activated sodium or calcium bentonite, neutralized copra fatty acid, an ethoxylated fatty alcohol and ethoxylated nonylphenole. The drawing of the tubes from the ingot mould using such a composition is often very difficult.

Therefore, it was an object of the present invention to provide a wash composition which essentially does not contain diatomite and which leads to good results, especially in a centrifugal casting process and large-scale casting process.

An aspect of the present invention relates to wash compositions (coating materials) for casting moulds, comprising a solvent component and a solids component, wherein the solids component comprises as main component a mixture of metakaolinite and pyrophyllite. Preferably, this wash composition contains less than 5 wt.-%, more preferably less than 3 wt.-%, still more preferably less than 1 wt.-%, based on all components of the wash composition, and most preferably no diatomite. In further preferred embodiments the solids component of the wash composition according to the invention comprises a mixture of metakaolinite and pyrophillite in a ratio of 1:3 to 20:1, preferably 1:1 to 14:1, more preferably 1:1 to 10:1, still more preferably 2:1 to 6:1, and most preferably in a ratio of 2:1 to 5:1.

A further preferred embodiment of the wash composition according to the invention further comprises at least one further component selected from the group consisting of bentonite and hectorite. Optionally, the wash according to the invention may further comprise binders, wetting agents, antifoaming agents, pigments, dyes and biocides.

A further aspect of the present invention relates to casting moulds comprising a top coating on at least one part of the surfaces of the casting moulds, which will come into contact with the casting metal, the top coating being produced by applying and drying a wash composition according to the invention. In a further embodiment of a casting mould the top coating according to the invention is applied onto an undercoating and optionally to further surface portions of the casting mould which are free of the undercoating, wherein in a preferred embodiment the undercoating is also obtained from a wash composition according to the invention.

A further aspect of the present invention refers to centrifugal casting processes and large-scale casting processes using casting moulds that have at least one top coating which is obtained from a wash composition according to the invention.

A further aspect of the present invention relates to a process for the production of a casting mould. In one embodiment a layer of the wash composition according to the invention is applied once or more times to at least one surface portion or to the complete surface of the casting mould, which will come into contact with the casting metal, and dried. In another embodiment first of all at least one layer of an undercoating is applied to the surface of the basic casting mould or to surface portions thereof, and the wash composition for producing the top coating is subsequently applied to this undercoating and optionally further surface portions of the basic casting mould and dried. In a further embodiment also a wash composition according to the invention is used for the preparation of the undercoating, wherein the composition of the wash composition for preparing the undercoating can be the same or different from that of the wash composition for preparing the top coating. Often zirconium silicate-containing washes are used for undercoatings, which optionally also form an additional protection for the basic casting mould due to an increased tendency to penetrate into the background.

In preferred embodiments the casting moulds according to the invention are used for the production of tubes, cylinder liners, engines and engine components, machine beds and turbines.

The present invention is based on the surprising finding that the wash compositions according to the invention, comprising a solids component which comprises as main component a mixture of metakaolinite and pyrophyllite, lead to similarly good and better casting results than wash compositions the solids component of which contains diatomite as main component. Advantages of the wash according to the invention in comparison to diatomite-containing washes in centrifugal casting are particularly aspects concerning health, security and marking. It is not known that metakaolinite and pyrophyllite have the high risk potential described for diatomite. In addition to the above, diatomite-containing substances possibly have to be marked as being dangerous to health, and diatomite, which, for example, is brushed off or shot-blasted from castings, has to be disposed of only as hazardous waste in the future. The mixture according to the invention furthermore has the advantage that due to its chemical composition it is fireproof and inert. Compared to zirconium washes and also pure pyrophyllite washes, a metakaolinite/pyrophyllite mixture shows excellent properties in large-scale casting due to the reactivity of metakaolinite with pyrophyllite and the refractability and fineness of grain (impregnation of the sand cavities) of the metakaolinite. Especially the high insulating values of the pyrophyllite/metakaolinite mixture effect a very good protection against so-called leaf ribs which can often be observed with quartz sand due to the thermal expansion of the quartz sand (quartz inversion) and the insufficient thermal stability especially in polyurethane-coldbox-cores.

Kaolinite is a triclinic two-layer clay mineral and the main component of kaolines. Depending on the particle size, the degree of orientation, heat duration and partial water vapour pressure the dehydration of kaolinite leads to metakaolinite. Kaolinite eliminates water from its hydroxyl groups at about 450° C. and higher. In connection with the present invention the term "metakaolinite" refers to a material obtainable from natural kaoline from which in a preferred embodiment essentially all impurities have been removed and which was heated at a temperature in the range of 750 to 950° C. in order to remove the constitutional water essentially completely, preferably completely. Suitable metakaolinite materials are, e.g., commercially available under the product name Satintone produced by the company Engelhard Cooperation, Iseli, USA.

Preferably, in the present invention metakaolinite having a specific surface according to BET of at least 10 $m^2/g$, preferably at least 25 $m^2/g$, measured according to DIN 66131, is used. The metakaolinite should have a loss on ignition of less than 3 wt.-%, preferably less than 1 wt.-%, measured according to DIN 38414. Preferred metakaolinite materials have an uncompressed bulk density of 100 to 300 g/l, preferably 150 to 200 g/l, measured according to DIN 53194. In a further preferred embodiment the metakaolinite shows a high specific surface, expressed in oil absorption, measured according to DIN 53109, between 50 and 120%, preferably between 85 and 120%. The metakaolinite powder preferably has a grain size of 0.05 to 20 μm, more preferably 0.1 to 10 μm, and has an average grain size in the range of preferably 1 to 5 μm.

The term "pyrophyllite", which in the present invention is used in admixture with metakaolinite, in the following description refers to a material which is obtained from natural pyrophyllite-containing ores of various extraction regions. The pyrophyllite material used has a pyrophyllite content of at least 40%, preferably at least 50% and more preferably at least 60%. "Roseki", agalmatolith, and an ore containing more than 90% pyrophyllite which is called "wonderstone" also can be used. Many of the commercially available pyrophyllite materials can be used in the present invention. The pyrophyllite material used may, if desired, be cleansed in advance by means of usual cleansing processes in order to remove accompanying minerals and impurities. Preferably, the pyrophyllite raw material is preprocessed before use. A preferred preprocessing method is the grinding of the raw material in special grinding mills which leads to pyrophyllite having a plate-like structure. Another preprocessing method is "planing off" small pyrophyllite plates from pyrophyllite raw materials. By means of common separation processes, such as sieving, air separation, and the like, the preprocessed pyrophyllite material can optionally be classified. Thereby, also undesired accompanying minerals can optionally be separated out. The small plates of the preprocessed pyrophyllite preferably have a microscopically determined size of 10 to 100 μm and a thickness of 1 to 10 μm. An example for a pyrophyllite form usable in the invention is the Pyrax RG series, for example, Pyrax RG 140 and Pyrax RG 200, commercially available from R.T. Vanderbilt Company Inc., Norwalk, USA. An especially preferred pyrophyllite form has a Mohs' hardness of 1 to 2, a density of 2.8 to 2.9 g/cm$^3$, and a PCE (ASTM C-24) of 27 to 28. By using coarse grainings the portion of secondary components of the pyrophyllite, which lead to undesired effects, can be kept low. By doing so, e.g. the portion of secondary components, such as quartz and mica, which lead to a reduced refractability of the material is minimized.

In a preferred embodiment the pyrophyllite to be used has an aspect (length to thickness ratio) of at least 5, preferably 10 to 30. Preferably, a pyrophyllite having an uncompressed bulk density of 300 to 600 g/l, preferably 300 to 400 g/l, measured according to DIN 53194, is used. The preferred pyrophyllite material has a density after tamping of 800 to 1800 kg/cm$^3$, preferably 900 to 1550 kg/cm$^3$ (DIN 55943). The preferred pyrophyllite material has a grain size of 5 to 600 μm, preferably 10 to 300 μm, more preferably 10 to 200 μm. Furthermore, the preferred pyrophyllite material has a shrinkage of at most 2%, preferably at most 1%. In the present invention, the pyrophyllite is used in hydrated form, i.e. the hydrate water which is present in natural form is not removed by heating or calcining before use. However, pyrophyllite materials which have been partially or completely dehydrated before use can also be used.

The wash composition of the present invention comprises a solids component the main component of which being of a mixture of metakaolinite and pyrophyllite. This mixture has a metakaolinite to pyrophyllite ratio of preferably 1:3 to 20:1, preferably 1:1 to 14:1, more preferably 1:1 to 10:1, still more preferably 2:1 to 6:1, and most preferably a ratio of 2:1 to 5:1. The wash composition according to the invention preferably contains less than 5 wt.-%, more preferably less than 2 wt.-%, still more preferably less than 1 wt.-%, and most preferably no diatomite.

In a preferred embodiment of the wash composition according to the invention the solids component additionally comprises bentonite, hectorite, or a mixture thereof. The content of bentonite, hectorite or of the mixture thereof usually is 0.1 to 10 wt.-%, preferably 0.1 to 5 wt.-%, and more preferably 0.3 to 3 wt.-%, based on all components of the composition.

Furthermore, the wash composition according to the invention optionally may additionally contain further conventionally used two-layer silicates and three-layer silicates such as, e.g., attapulgite, serpentines, kaolins, smectites such as saponite, montmorillonite, beidellite and nontronite, vermiculite, illite and mica, in smaller amounts, for example 0.5 to 4.0 wt.-%, preferably 1.0 to 2.0 wt.-%.

The wash composition according to the invention optionally may contain one or more further components such as, for example, binders, wetting agents, anti-foaming agents, pigments, dyes, and biocides.

The object of a binder is primarily to enable the wash composition which has been applied to the casting mould, to bind the ingredients of the wash composition including metakaolinite and pyrophyllite after drying. Preferably, the binder cures irreversibly and thus results in an abrasion-resistant coating on the casting mould. The abrasion resistance is of great importance for the finished coating since the coating may be damaged if there is a lack of abrasion resistance. In particular, the binder should not re-soften due to humidity. In preferred embodiments the binder is cured by means of commonly known methods. In acrylate systems, for example, the curing may be carried out by using radical formers which, for example, form radicals when being subjected to UV radiation. According to the invention, all binders which are conventionally applied in aqueous and/or water-alcohol systems may be used. Starch, dextrine, peptides, polyvinyl alcohol, polyvinyl acetate copolymers, polyacrylic acid, polystyrene, polyvinyl acetate-polyacrylate dispersions and mixtures thereof may be used as binders. In a preferred embodiment of the invention the binder is an alkyd resin dispersion which is soluble in water as well as in lower alcohols such as ethanol, propanol, and isopropanol. Examples for alkyd resins are unmodified water-dispersible alkyd resins based on a natural oil or its fatty acids with polyalcohols, as described, e.g., in U.S. Pat. No. 3,442,835, or isocyanate-modified alkyd resins as described, e.g., in U.S. Pat. No. 3,639,315 and which are preferred, or epoxy-urethane-modified alkyd resins according to DE 43 08 188. Products of the Necowel series of ASK GmbH, 40721 Hilden, Germany, can for example be used. Further preferred binders are polyvinyl alcohols and polyvinyl acetate copolymers. Preferably, the binders are used in an amount of 0.1 to 5 wt.-%, more preferably 0.5 to 2 wt.-%, based on all components of the wash composition.

Anionic and non-ionic surfactants having medium and high polarity (HSB value of 7 or higher) known to the skilled person may be used as wetting agents. An example for a wetting agent which can be used in the present invention is disodium dioctylsulfosuccinate. The wetting agents are preferably used in an amount of 0.01 to 1 wt.-%, more preferably 0.05 to 0.3 wt.-%, based on all components of the wash composition.

Defoamers or anti-foaming agents are used to prevent foam formation during the production of the wash composition according to the invention and the application thereof. Foam formation during the application of the wash composition may lead to an irregular thickness of the layer and holes in the coating. Silicone or mineral oils may be used as defoamers. In the present invention, defoamers are used in an amount of 0.01 to 1 wt.-%, more preferably 0.05 to 0.3 wt.-%. Conventionally used pigments and dyes may optionally be used in the wash composition according to the invention. They are optionally added in order to effect another contrast, for example between the various layers, or to cause a higher separation effect of the wash from the casting. Examples for pigments are red and yellow iron oxide as well as graphite. Examples for dyes are commercially available dyes such as the Luconyl dye series of BASF. Usually, the dyes and pigments are used in an amount of 0.01 to 10 wt.-%, preferably 0.1 to 5 wt.-%.

To wash compositions the solvent component of which mainly consists of water, so-called water washes, biocides are generally added in order to prevent a bacterial infestation and, thus, to avoid a negative influence on the rheology and the bonding strength of the binders. Examples for biocides to be used are formaldehyde, 2-methyl-4-isothiazoline-3-one MIT), 5-chloro-2-methyl-4-isothiazoline-3-one (CIT), and 1,2-benzoisothiazoline-3-one (BIT). Preferably, MIT, BIT, or a mixture thereof is used. The biocides are generally used in an amount of 0.01 to 0.5 wt.-% or 10 to 1000 ppm, preferably 50 to 500 ppm.

The solvent component of the wash composition according to the invention comprises water or one or more volatile, preferably aliphatic alcohols or mixtures of alcohol(s) and water, and optionally one or more organic volatile solvents different from the above-mentioned alcohols as a further component. Wash compositions the solvents of which mainly consist of water are usually designated as water washes, wash compositions the solvents of which mainly consist of alcohol or alcohol mixtures are designated as alcohol washes. In an embodiment of the present invention the solvent component comprises 0 to 100 wt.-%, preferably 20 to 80 wt.-%, more preferably 60 to 40 wt.-% of water, and as a further component 0 to 100 wt.-%, preferably 40 to 60 wt.-% of one or more volatile alcohols, based on all components of the solvent component. The invention may be used for pure water washes as well as for pure alcohol washes as well as for water/alcohol mixtures and for water washes which can be diluted with alcohol. Examples for preferred alcohols are aliphatic $C_1$-$C_5$-alcohols. Examples for preferred $C_1$-$C_5$-alcohols are methanol, ethanol, n-propanol, and isopropanol. Preferably, ethanol, isopropanol and mixtures thereof are used as volatile alcohols. Additionally, further organic volatile solvents, preferably in small amounts, may optionally be used. Examples therefor are acetic acid alkyl ester, such as acetic acid ethyl ester and acetic acid butyl ester, and ketones, such as acetone and methylethyl ketone.

In a preferred embodiment a wash composition according to the invention comprises 10 to 40 wt.-% metakaolinite, 5 to 20 wt.-% pyrophyllite, and 10 to 85 wt.-% water, based on all components of the composition. A further preferred embodiment of a wash composition according to the invention comprises the following components: 15 to 40 wt.-% metakaolinite, 7 to 20 wt.-% pyrophyllite, 0.1 to 5 wt.-% bentonite, hectorite or a mixture thereof, 0.5 to 2 wt.-% binder, 0.01 to 0.5 wt.-% biocide, and 10 to 78 wt.-% water. It is also possible to produce wash compositions the solvent component of which first of all consists only of water. When these washes are diluted with an alcohol or an alcohol mixture they may be used as alcohol washes. Here, preferably ethanol, propanol, isopropanol, and mixtures thereof are used.

The wash compositions according to the invention are produced by common methods. For example, a wash composition according to the invention is produced by providing a large part of the total amount of the solvent component, preferably the total amount of the solvent component, e.g. the total amount of water, and digesting clay minerals such as bentonite and hectorite therein using a high-shearing mixer (e.g. 400 to 2000 rpm). Subsequently, the fireproof components, for example first metakaolinite, then pyrophyllite, pigments and dyes are mixed in until a homogenous mixture forms. The order of addition does not play any or only a subordinate role, which then may easily be determined by a person skilled in the art. Finally, wetting agents, anti-foaming agents, biocides and binders are mixed in. The wash compositions are produced at a temperature of preferably 5 to 50° C., more preferably 10 to 30° C., and a number of revolutions of the mixer of preferably 400 to 2000 rpm, more preferably 1000 to 1500 rpm, and a mixer having a toothed disc having preferably d/D=0.3 to 0.7, more preferably d/D=0.4 to 0.6.

For commercial distribution, a wash composition according to the invention can be produced and sold in form of a ready-to-use formulated coating composition, for example a ready-to-use wash. Furthermore, the wash composition according to the invention can be produced and sold in a concentrated form. In the latter case, for providing a ready-to-use wash, the suitable amount of the solvent component has to be added which is necessary to provide the required viscosity and density properties of the wash. Moreover, it is imaginable to provide and sell the wash composition according to the invention in the form of a kit (multicomponent package containing two or more containers for different components) wherein, for example, the solids component and the solvent component are abreast present in separate containers. Thereby, the solids component may be present as a solids mixture in powder form in a separate container. Further liquid components optionally to be used such as, e.g., binders, wetting agents, anti-foaming agents, pigments, dyes and biocides may, on the other hand, be present in this kit in one or more separate containers. The solvent component may either comprise the components which may optionally additionally be used, e.g. in a common container, or it can be present in a separate container isolated from further optional components. For the production of a ready-to-use wash the suitable amounts of the solids component, the optional further components and the solvent component are mixed with each other. In a ready-to-use condition a wash composition according to the invention preferably comprises a solids content of 20 to 80 wt.-%, preferably 30 to 70 wt.-%, based on all components of the wash. Furthermore, it is also possible to provide a wash composition according to the invention the solvent component of which first of all consists only of water. By adding a volatile alcohol or an alcohol mixture, preferably ethanol, propanol, isopropanol, and mixtures thereof, in preferred amounts of 40 to 200 wt.-%, based on the water wash, a ready-to-use alcohol wash may be provided from this water wash. The solids content of an alcohol wash according to the invention thereby preferably is 20 to 60 wt.-%, more preferably 30 to 40 wt.-%.

Depending on the desired use of the wash composition, e.g. as undercoating or top coating, and the desired layer thickness of the wash composition to be applied further characteristic parameters of the wash composition can be adjusted. Thus, wash compositions according to the invention which are used for coating moulds and cores in foundry practice, have, in a preferred embodiment, a viscosity of 12 to 25 s, more preferably 14 to 16 s (determined according to DIN 53211; flow cup 4 mm, Ford-Cup). Preferred densities of a ready-to-use wash composition are in the range of 20 to 50° Bé, more preferably 25 to 35° Bé (determined according to the Baumé floatation weight loss method; DIN 12791).

The wash compositions according to the invention may be used for the coating of casting moulds. The term "casting mould" used herein comprises all sorts of bodies which are necessary for producing a casting, such as cores, moulds and ingot moulds. The use of the wash compositions according to the invention also comprises a partial coating of casting moulds. Preferably, the surfaces of a casting mould which are contacted with the casting metal are coated. The wash compositions are suitable for all conceivable uses in which a coating of casting moulds with washes is desired. Sand cores which are bound by PUR coldbox, water-glass $CO_2$, MF resol, resol $CO_2$, furan resin, phenolic resin, or water-glass/ester, can be mentioned as examples for casting moulds, i.e. for cores and moulds in foundry processes. Other examples for preferred casting moulds which can be coated with the wash compositions according to the invention are, e.g., described in "Formstoffe und Formverfahren", Eckart Flemming and Werner Tilch, Wiley VCH, 1993, ISBN 3-527-30920-9.

A process for coating a casting mould with a wash composition according to the invention comprises the steps:

(a) providing a basic mould of a casting mould (uncoated basic casting mould);

(b) providing a wash composition according to the invention;

(c) optionally applying and drying at least one layer of an undercoating composition on at least one part of the surface of the basic casting mould;

(d) applying at least one layer of a wash composition according to the invention on at least one part of the surface of the basic casting mould or of the casting mould containing an undercoating;

(e) drying the wash composition; and (f) optionally curing the dried wash;

wherein a top coating is produced.

Generally, in casting moulds for centrifugal casting processes the wash is applied in several operations, i.e. layers, wherein normally the applied wash layer is dried partially or completely before the application of the next wash layer. As a rule, two to five layers are applied. Normally, in the large-scale casting (heavy casting >10 tons (t)) the wash composition is only applied once, wherein at critical places an undercoating can first be applied. In light casting ((casting up to 2 t) and medium casting (up to 2 to 10 t) generally no undercoating is applied.

The application of an undercoating onto the basic casting mould, if desired, may be carried out by means of all application methods conventionally used in the technics. As base materials the undercoatings may contain e.g. clays, talcum, quartz, mica, zirconium silicate, magnesite, aluminum silicate, and chamotte. These base materials are the portion of the undercoating determining its function. They cover the surface of the casting mould, seal the sand pores against the penetration of the casting metal and inter alia also serve as thermal insulations vis-á-vis the casting mould. Conventionally used application methods are dip coating, flow coating, spray coating and spread coating. In a preferred embodiment also a wash composition according to the invention can be used as an undercoating. The undercoating has a dry layer thickness of at least 0.1 mm, preferably at least 0.2 mm, more preferably at least 0.45 mm and most preferably in the range of 0.3 mm to 1.5 mm. Water washes as well as alcohol washes may be used as undercoatings.

For the production of a top coating, a wash composition according to the invention can be applied by means of all conventional application methods known in the technics. Examples for preferred application methods are dip coating, flow coating, spray coating and spread coating. Conventional application methods are, e.g., described in "Formstoffe und Formverfahren", Eckart Flemming and Werner Tilch, Wiley VCH, 1993, ISBN 3-527-30920-9.

If dip coating is used as an application method, the casting mould optionally containing an undercoating is dipped into a container containing a ready-to-use wash composition according to the invention for about 2 seconds to 2 minutes. The time required for the excess wash composition to flow off after dip coating, depends on the flow-off behaviour of the used wash composition. After a sufficiently long flowing-off time the coated casting mould is dried.

If spray coating is used as an application method, commercially available pressure pot sprayers are used. Here, the diluted wash composition is filled into a pressure pot. By means of an excess-pressure to be adjusted the wash composition may be pressed into an airgun, where it is sprayed by means of separately adjustable air for spraying. When spraying, it has preferably to be taken care that the airgun is adjusted in such a way that the pressure for the wash composition and the air for spraying is regulated in such a manner that the sprayed wash hits the mould or the core when the wash is still wet, but is evenly applied. The application of the wash composition according to the invention may be conducted in one or more layers. When applying more layers, each single layer may be dried partially or completely after application.

All conventional drying methods known in the art such as, for example, drying by exposure to air, drying with dehumidified air, drying with microwave or infrared radiation, drying in a convection oven, or the like can be used. In a preferred embodiment of the invention the coated casting mould is dried in a convection oven at 100 to 250° C., more preferably at 120 to 180° C. When using alcohol washes the wash composition according to the invention is preferably dried by burning the alcohol or the alcohol mixture. Hereby, the coated casting mould is additionally heated by the combustion heat. In a further preferred embodiment the coated casting mould is dried without further treatment under exposure to air.

After drying, the dried wash may optionally be further cured. All known curing methods may be used therefor. Added curing agents may be activated by means of heat or electromagnetic radiation. Water or alcohol washes may be dried, e.g., at temperatures below 100° C. For the curing of certain binders, e.g. phenolic resins, temperatures of about 140 to 160° C. are required. Depending on the temperature used the drying and curing of the wash may be carried out in one or in separate steps. Free-radical and ionic curing methods would also be conceivable.

The dry layer thickness of the top coating obtained from the wash composition according to the invention is at least 0.1 mm, preferably at least 0.2 mm, more preferably at least 0.3 mm, still more preferably at least 0.45 mm, especially preferred at least 0.55 mm, and most preferably in a range of 0.3 mm to 1.5 mm. Hereby, the dry layer thickness is the layer thickness of the dried wash obtained by drying the wash composition by essentially completely removing the solvent component and optionally subsequently curing. The dry layer thickness of the undercoating and the top coating is preferably determined by measurement using a comb for determining the wet film thickness. The layer thickness may, for example, be determined with the comb by frequently scratching off the wash at the end marks of the comb until the background appears. Then, the dry layer thickness can be read off at the marks of the teeth. Instead of doing so one also can measure the wet layer thickness in a matted condition, wherein then the dry layer thickness is 70 to 80% of the thickness of the matted layer. (A "matted" layer is a layer which is no longer capable of flowing, in which the solvent content is reduced that much that the surface does no longer show any brightness).

Casting moulds having a dried wash according to the invention, in the following also referred to as top coating, are preferably used in centrifugal casting processes and large-scale casting processes. The basic principles of said casting methods are described, e.g., in Stefan Hasse, "Gieβereilexikon", Schiele & Schön, Berlin, 1997. In large-scale casting a resting permanent mould, e.g. made of sand, steel or cast iron, is filled with the liquid casting metal, generally under the influence of gravity. The shape of the mould casting is completely predetermined by the mould. In a centrifugal casting process the casting metal is filled into a tubular or annular ingot mould rotating on its axis, wherein the casting metal is formed into cans, rings and tubes (e.g. pressure tubes made of cast iron, tubes made of copper and copper alloys, piston rings, cylinder liners, rib cylinders) under the influence of centrifugal force. The rotationally symmetric cavity is generated by centrifugal force, which remains until solidification of the casting. The thickness of the walls results from the amount of the added metal. In the large-scale casting process the wash composition according to the invention is preferably applied by dip coating or flow coating the basic casting mould in a dip tank or a flood tank. Preferably, in the large-scale casting process the top coatings having a dry layer thickness of 0.3 to 1.5 mm are produced from the wash composition according to the invention. In the centrifugal casting process preferably a top coating having a dry layer thickness in the range of 0.3 to 1.2 mm is prepared from the wash composition according to the invention.

Casting moulds comprising a top coating prepared from the wash composition according to the invention are amongst other things used for the production of tubes, cylinder liners, engines and engine components, machine beds, turbines and general machine components.

The invention is further described by the following examples.

EXAMPLES

Centrifugal Casting Wash

The centrifugal casting wash used in the following examples contained the following components (wt.-%):

| | |
|---|---|
| Satintone Plus | 25.00 |
| Pyrax RG 140 | 25.00 |
| bentonite | 00.60 |
| hectorite | 00.20 |
| biocide | 00.20 |
| water | 49.00 |

Santintone Plus: metakaolinite, particle size 2.0 μm; produced by Engelhard Cooperation, Iseli, USA Pyrax RG 140: pyrophyllite having a particle size of about 80 μm; produced by R. T. Vanderbilt Company Inc., Norwalk, USA bentonite: Greenbond; produced by Südchemie AG, 80333 Munich, Germany hectorite: Bentone EW; produced by Elementis Specialities Inc., NJ 08520 Hightstown, USA biocide: Acticide MBS (BIT, MIT) of Thor Ltd., Margate Kent CT9 4JY, UK.

The centrifugal casting wash was prepared as follows: The total amount of water is provided and the bentonite and hectorite are digested therein for at least 15 minutes by using a high-shearing mixer Ekato (1000 rpm, toothed disc having d/D=0.5). Subsequently, the fireproof components metakaolinite and pyrophyllite are added and mixed in for at least 15 minutes until a homogenous mixture is formed. Finally, the biocide was mixed in. The viscosity was 9.6 seconds with a DIN 6 cup, or 33 seconds with a DIN 4 cup.

Water-Dilutable Die Casting Wash

The water-dilutable die casting wash used in the following examples contained the following components (wt.-%):

| | |
|---|---|
| Satintone W | 25.00 |
| Pyrax RG 140 | 25.00 |
| bentonite | 02.00 |
| wetting agent | 00.05 |
| defoamer | 00.20 |
| binder solution | 02.00 |
| biocide | 00.20 |
| water | 45.55 |

Santintone W: metakaolinite, bulk density (loose) about 300 g/l, particle size about 1.5 μm; produced by Engelhard Cooperation, Iseli, USA Pyrax RG 140: pyrophyllite having a particle size of about 80 μm; produced by R. T. Vanderbilt Company Inc., Norwalk, USA bentonite: Greenbond; produced by Südchemie AG, 80333 Munich, Germany wetting agent: conventional wetting agent of the company Henkel AG, 40589 Düsseldorf, Germany defoamer: conventional defoamer of the company Henkel AG, 40589 Düsseldorf, Germany binder solution: Polyviol; Wacker-Chemie GmbH, 81737 Munich, Germany biocide: Acticide MBS (BIT, MIT) of Thor Ltd., Margate Kent CT9 4JY, UK.

The die casting wash was produced according to the process described above for the centrifugal casting wash. The density of the produced wash was 1.3 to 1.4 g/cm$^3$ and the Brookfield viscosity was 2 to 5 Pa·s.

Alcohol-Dilutable Die Casting Wash

The alcohol-dilutable die casting wash used in the following examples contained the following components (wt.-%):

| | |
|---|---|
| Satintone W | 25.80 |
| Pyrax RG 140 | 25.80 |
| bentonite | 02.06 |
| graphite | 05.16 |
| iron oxide | 03.10 |
| wetting agent | 00.05 |
| defoamer | 00.20 |
| binder solution | 01.91 |
| biocide | 00.05 |
| water | 36.12 |

Santintone W: metakaolinite, produced by Engelhard Cooperation, Iseli, having a bulk density (loose) of about 300 g/l and a particle size of about 1.5 μm;

Pyrax RG 140: pyrophyllite having a particle size of about 80 μm; produced by R. T. Vanderbilt Company Inc., Norwalk, USA bentonite: Greenbond; produced by Südchemie AG, 80333 Munich, Germany wetting agent: conventional wetting agent of the company Henkel AG, 40589 Düsseldorf, Germany graphite: company Georg H. Luh GmbH, 65396 Walluf, Germany iron oxide: yellow iron oxide, Bayer AG, 51368 Leverkusen, Germany binder solution: Necowel, ASK GmbH, 40721 Hilden, Germany biocide: Acticide MBS (BIT, MIT) of Thor Ltd., Margate.

The die casting wash was produced according to the process described above for the centrifugal casting wash. The finished wash had a spindle density of 80° Bé.

Example 1

(Centrifugal Casting Process Using the Above-Mentioned Centrifugal Casting Wash)

The above-mentioned centrifugal casting wash had the following wash particulars:

density: 50° Bé viscosity: 9.6 seconds with a DIN 6 cup; 33 seconds with a DIN 4 cup.

For the working consistency 15 l (20 kg) wash are further diluted with 5 l water to give a density of 37° Bé and a viscosity of 13.2 s (DIN 4 cup).

A tube is produced by a centrifugal casting process. The used ingot mould (inner diameter of about 90 mm) which had been pre-heated to about 200° C. was coated by applying the wash composition according to the invention with a wash pressure of 0.9 bar by means of a drain (DE: Düker) spraying lance and a feed rate of 500 mm/s. The dry layer thickness was 0.65 mm. Due to the sensible heat of the ingot mould the wash dried during the spraying process. A top coating having a suitable surface was obtained. The tube showed good drawing behaviour in centrifugal casting. The metallurgical tests showed the desired graphite formation in the gray-iron casting (Fe, C, Si) and the appropriate range of hardness of the gray-iron casting which indicates a sufficient insulating effect of the wash.

Example 2

(Centrifugal Casting Process Using the Above-Mentioned Centrifugal Casting Wash)

As in Example 1, a tube was produced by means of a centrifugal casting process. Contrary to Example 1, however, the dry layer thickness of the top coating was 0.85 mm. The obtained top coating had a usable surface. The drawing behaviour of the tube was good. The metallurgical tests showed the desired formation of graphite and an appropriate range of hardness of the grey-iron casting which indicates a sufficient insulating effect of the wash.

Example 3

PUCB Core for a V-type Engine

A PUCB (polyurethane coldbox) core for a V-type engine was treated with the above-mentioned water-dilutable die casting wash. 100% no-bake regenerated used sand was used for the core (no-bake means a self-curing process wherein, e.g. furan resin is cured with paratoluene sulfonic acid. The sand of these cores or moulds is regenerated, i.e. it is made reusable by means of an abrading process. In this example, the sand was used for the gas-curing (amine) PUCB process.) For the working consistency 100 parts by weight of the die casting wash were diluted with 5 parts by weight of water.

Adjusting of the wash: density: 44° Bé viscosity: >25 s (DIN 4 cup)

The wash was applied to the core by means of flow coating. The flow behaviour of the wash was good and the wet layer thickness was 250 μm. The core was dried in a chamber furnace with recirculating air at 160 to 180° C. The covering of the dried wash for this core was at the lower limit. The casting result was free from defects.

Example 4

Core for a Crank Chamber, Furan Resin

Similar to Example 3, the above-mentioned water-dilutable die casting wash was applied to an untreated core for a crank chamber, made of furan resin. For the working consistency 100 parts by weight of the wash were diluted with 20 parts by weight of water.

Adjusting of the wash: density: 40° Bé viscosity: >18.4 s (DIN 4 cup).

The flow behaviour of the wash was good and the wet layer thickness was 300 μm. The covering of the dried wash was good. The casting result was free from defects.

Example 5

No-bake moulds were treated with the above-mentioned alcohol-dilutable die casting wash. In the delivery status, the die casting wash as described above had a spindle density of 80° Bé and was diluted to a spindle density of 9° Bé, a viscosity of 13.0 s and a weight per liter of 1000 g/l, using about 80% dilution (60% isopropanol, 40% ethanol), based on the total amount of the wash. The no-bake moulds were flooded with these adjustments. Compared to the conventional pyrophyllite/isopropanol washes considerably less malodour prevailed at the flooding plant. The wet layer thickness was 250 to 300 μm. The moulds could also be completely dried in 30 cm deep cases by the burning of the alcohol and showed a good abrasion resistance. Drying cracks or gas cavities could not be observed. The casting results exhibited no recognizable problems compared to pyrophyllite/isopropanol washes.

The invention claimed is:

1. A wash composition for casting moulds comprising a solvent component and a solids component, characterized in that the solids component comprises as a main component a mixture of metakaolinite and pyrophyllite.

2. A wash composition according to claim 1, wherein the wash composition has less than 5 wt.-%, of diatomite, based on all components of the wash composition.

3. A wash composition according to claim 1, wherein the solids component comprises a mixture of metakaolinite and pyrophyllite in a ratio of 1:3 to 20:1.

4. A wash composition according to claim 1, wherein the solids component comprises a mixture of metakaolinite and pyrophyllite in a ratio of 1:1 to 14:1.

5. A wash composition according to any one of claims 1 to 4, wherein the metakaolinite has at least one of the following:

a) a specific surface according to BET of at least 10 $m^2/g$, measured according to DIN 66 131;

b) an uncompressed bulk density of 100 to 300 g/l measured according to DIN 53 194;

c) a grain size of 0.1 μm to 10 μm.

6. A wash composition according to claim 5, wherein the wash composition comprises 10 to 40 wt.-% metakaolinite, 5 to 20 wt.-% pyrophyllite, and 10 to 85 wt.-% water, based on all components of the composition.

7. A wash composition according to claim 5, wherein the wash composition comprises the following components:

15 to 40 wt.-% metakaolinite, 7 to 20 wt.-% pyrophyllite, 0.1 to 5 wt.-% bentonite and/or hectorite, 0.0 to 2 wt.-% binder, 0.01 to 0.5 wt.-% biocide, and 10 to 78 wt.-% water.

8. A wash composition according to any one of claims 1 to 4, wherein the pyrophyllite has at least one of the following:

a) an aspect (length to thickness ratio) of at least 5;

b) an uncompressed bulk density of 300 to 600 g/l measured according to DIN 53 194;

c) a grain size of 0.1 μm to 10 μm; and d) a grain size of 20 μm to 200 μm.

9. A wash composition according to claim 8, wherein the wash composition comprises 10 to 40 wt.-% metakaolinite, 5 to 20 wt.-% pyrophyllite, and 10 to 85 wt.-% water, based on all components of the composition.

10. A wash composition according to claim 8, wherein the wash composition comprises the following components:

15 to 40 wt.-% metakaolinite, 7 to 20 wt.-% pyrophyllite, 0.1 to 5 wt.-% bentonite and/or hectorite, 0.0 to 2 wt.-% binder, 0.01 to 0.5 wt.-% biocide, and 10 to 78 wt.-% water.

11. A wash composition according to any one of claims 1 to 4 further comprising 0.1 to 10 wt of bentonite and/or hectorite, based on all components of the composition.

12. A wash composition according to any one of claims 1 to 4 comprising at least one further component selected from the group consisting of binders, wetting agents, defoamers, pigments, dyes and biocides.

13. A wash composition according to claim 12, wherein the binder consists of a dispersion of an alkyd resin which is soluble in water as well as in ethanol or isopropanol.

14. A wash composition according to claim 13, wherein the wash composition comprises
10 to 40 wt.-% metakaolinite,
5 to 20 wt.-% pyrophyllite, and
10 to 85 wt.-% water,
based on all components of the composition.

15. A wash composition according to claim 13, wherein the wash composition comprises the following components:
15 to 40 wt.-% metakaolinite,
7 to 20 wt.-% pyrophyllite,
0.1 to 5 wt.-% bentonite and/or hectorite,
0.0 to 2 wt.-% binder,
0.01 to 0.5 wt.-% biocide, and
10 to 78 wt.-% water.

16. A wash composition according to any one of claims 1 to 4, wherein the solvent component comprises 20 to 80 wt.-% of water and optionally as further component 0 to 60 wt.-% of one or more organic volatile solvents, based on all components of the composition.

17. A wash composition according to claim 16, wherein the organic volatile solvent is an alcohol or an alcohol mixture, preferably selected from the group consisting of ethanol, propanol, isopropanol and mixtures thereof.

18. A wash composition according to claim 16, wherein the wash composition comprises
10 to 40 wt.-% metakaolinite,
5 to 20 wt.-% pyrophyllite, and
10 to 85 wt.-% water,
based on all components of the composition.

19. A wash composition according to claim 16, wherein the wash composition comprises the following components:
15 to 40 wt.-% metakaolinite,
7 to 20 wt.-% pyrophyllite,
0.1 to 5 wt.-% bentonite and/or hectorite,
0.0 to 2 wt.-% binder,
0.01 to 0.5 wt.-% biocide, and
10 to 78 wt.-% water.

20. A wash composition according to any one of claims 1 to 4, wherein the solvent component is only water.

21. A wash composition according to any one of claims 1 to 4, wherein the wash composition comprises
10 to 40 wt.-% metakaolinite,
5 to 20 wt.-% pyrophyllite, and
10 to 85 wt.-% water,
based on all components of the composition.

22. A wash composition according to any one of claims 1 to 4, wherein the wash composition comprises the following components:
15 to 40 wt.-% metakaolinite,
7 to 20 wt-% pyrophyllite,
0.1 to 5 wt.-% bentonite and/or hectorite,
0.0 to 2 wt.-% binder,
0.01 to 0.5 wt.-% biocide, and
10 to 78 wt.-% water.

23. A wash composition according to any one of claims 1 to 4, wherein the metakaolinite has at least one of the following:
a) a specific surface according to BET of at least 25 $m^2/g$, measured according to DIN 66 131;
b) an uncompressed bulk density of 200 g/l, measured according to DIN 53 194; and
c) a grain size of 0.1 μm to 10 μm.

24. A wash composition according to any one of claims 1 to 4, wherein the pyrophyllite has at least one of the following:
a) an aspect (length to thickness ratio) of 10 to 30;
b) an uncompressed bulk density of 300 to 400 g/l, measured according to DIN 53 194;
c) a grain size of 0.1 μm to 10 μm; and
d) a grain size of 20 μm to 200 μm.

25. A wash composition according to any one of claims 1 to 4 further comprising 0.1 to 5 wt.-% of bentonite and/or hectorite, based on all components of the composition.

26. A wash composition according to any one of claims 1 to 4 further comprising 0.5 to 3 wt-% of bentonite and/or hectorite, based on all components of the composition.

27. A casting mould comprising a top coating on the casting side of the casting mould, which has been produced by applying and drying a wash composition according to claim 1.

28. A casting mould according to claim 27, wherein the top coating has a dry layer thickness of at least 0.1 mm.

29. A casting mould according to claim 27, wherein at least one part of the top coating is applied onto an undercoating.

30. A centrifugal casting process comprising the steps of:
a) providing a casting mould according to claim 27;
b) filling the casting mould with casting material; and
c) subjecting the casting mould to centrifugal forces.

31. A large-scale casting process comprising the steps of:
a) providing a casting mould according to claim 27; and
b) filling the casting mould with casting material.

32. A method for the production of an article selected from the group consisting of tubes, cylinder liners, engines and engine components, machine beds and turbines, comprising the step of forming said article in a casting mould according to claim 27.

33. A casting mould according to claim 27, wherein the top coating has a dry layer thickness of at least 0.2 mm.

34. A casting mould according to claim 27, wherein the top coating has a dry layer thickness of 0.3 mm to 1.5 mm.

35. A method for producing a casting mould comprising, for the production of a top coating, applying and drying of at least one layer of a wash composition on at least one part of the surface of the casting mould, wherein a wash composition according to claim 1 is used.

36. A method according to claim 35, wherein first at least one layer of an undercoating is applied to at least one part of the surface of the casting mould, and wherein the wash composition is applied to the undercoating and optionally to further parts of the surface of the casting mould.

37. A method according to claim 36, wherein the wash composition is also used for the production of the undercoating.

38. A method according to claim 35, wherein the top coating has a dry layer thickness of at least 0.1 mm.

39. A method according to claim 35, wherein the top coating has a dry layer thickness of at least 0.2 mm, and more preferably 0.3 to 1.5 mm.

40. A method according to claim 35, wherein the top coating has a dry layer thickness of 0.3 to 1.5 mm.

41. A wash composition according to claim 1, wherein the wash composition has less than 3 wt.-% of diatomite, based on all components of the wash composition.

42. A wash composition according to claim 1, wherein the wash composition has less than 1 wt.-% of diatomite, based on all components of the wash composition.

43. A wash composition according to claim 1, wherein the solids component comprises a mixture of metakaolinite and pyrophyllite in a ratio of 1:1 to 10:1.

44. A wash composition according to claim 1, wherein the solids component comprises a mixture of metakaolinite and pyrophyllite in a ratio of 2:1 to 6:1.

45. A wash composition according to claim 1, wherein the solids component comprises a mixture of metakaolinite and pyrophyllite in a ratio of 2:1 to 5:1.

* * * * *